United States Patent [19]

Ralston

[11] Patent Number: 4,779,940

[45] Date of Patent: Oct. 25, 1988

[54] WORK-STORAGE ASSEMBLY

[76] Inventor: Kenneth D. Ralston, R.R. #3, 6 Ponderosa Dr., Flagstaff, Ariz. 86004

[21] Appl. No.: 170,890

[22] Filed: Mar. 21, 1988

[51] Int. Cl.[4] ..... A47B 85/00

[52] U.S. Cl. ..... 312/241; 312/240; 190/12 R

[58] Field of Search ..... 312/240, 241; 190/12 A, 190/12 R, 11; 206/541

[56] References Cited

U.S. PATENT DOCUMENTS

| | | | |
|---|---|---|---|
| 3,353,885 | 11/1967 | Hanson | 312/240 X |
| 3,512,620 | 5/1970 | Bell et al. | 190/11 |
| 4,034,518 | 7/1977 | Trecker | 321/241 X |
| 4,187,785 | 2/1980 | Juh | 190/12 R |
| 4,195,889 | 4/1980 | Coyne | 312/241 X |

*Primary Examiner*—Joseph Falk

*Attorney, Agent, or Firm*—Nissle & Leeds

[57] ABSTRACT

An improved compact portable storage unit. The unit includes an articulated work stand which can be disassembled and stored in the doors of the unit. The doors of the unit are slidably removable and are used to form work stations and shelving on the articulated support stand.

1 Claim, 2 Drawing Sheets

16
14
17
12
54
29
52
99
50
53
30
31
28
15
51
101
102
57
103

33
22
31
11
28
38
32
34
93
97
23
13
96
21
94
39
24
91
95
37
30
35
20
92
29
26
25
90

36
27

13
91
95
92
90
100
15
99
50
12
14
98
40
29
16
60

20
16

WORK-STORAGE ASSEMBLY

This invention relates to portable storage units.

More particularly, the invention pertains to a portable storage unit which can be disassembled and reassembled into a support stand and into work stations removably mounted on the support stand, the work stations providing reach through storage compartments accessible from either side of the support stand and providing horizontal work areas adjacent the storage compartments.

In a further respect, the invention pertains to a portable storage unit having doors which function as storage containers and which are slidably removable from said unit to form work stations adjacent said unit.

In still another respect, the invention pertains to a portable work-storage unit having an articulated support frame which is disassembled for storage in one of the doors of the work-storage unit.

A wide variety of portable, readily accessible storage-work units have been developed for storing and utilizing various types of materials. Tool boxes, fishing tackle boxes, and cooking utensil and foodstuff containers are well known examples of such work-storage units. Such prior art work-storage units are often intended to be placed on the ground or on a counter top to be opened and used. Attempting to transport a table or support stand with such units, especially to remote uninhabited areas, is impractical. The doors or lids on prior art work-storage units are normally hinged or permanently attached to the unit. Hinging the doors facilitates opening and closing of the doors in normal fashion but does not promote use of the doors as a support surface because the hinges normally can not support both the door and a significant amount of additional weight carried by the door. Further, the doors of conventional work-storage units are provided with a latch mechanism to hold the door closed. Finally, conventional work-storage units do not include additional work surfaces or shelves which are stored and transported in the unit and removed for use in conjunction with the work-storage unit.

Accordingly, it would be highly desirable to provide a portable compact self-contained work-storage unit which includes elements which can be assembled into an articulated support frame to support the work-storage unit and which includes doors which can be utilized as work stations and do not require hinge or latch mechanisms to be maintained in place on the work-storage unit.

It would also be highly desirable to provide a self-contained work-storage unit of the type described which would permit individuals to work on either side of the unit and to reach and communicate through the work-storage unit.

Therefore, it is a principal object of the invention to provide an improved portable work-storage unit.

A further object of the invention is to provide an improved compact work-storage unit which includes a plurality of rigid, elongate elements which can be assembled to form an articulated support stand for the work-storage unit.

Another object of the invention is to provide a work-storage unit having doors which are not permanently affixed to the unit and which can be utilized as work stations adjacent the work-storage unit.

Still another object of the invention is to provide a work-storage unit of the type described in which the doors store the disassembled articulated support stand.

These and other, further and more specific objects and advantages of the invention will be apparent to those skilled in the art from the following detailed description thereof, taken in conjunction with the drawings, in which.

Figure 1:
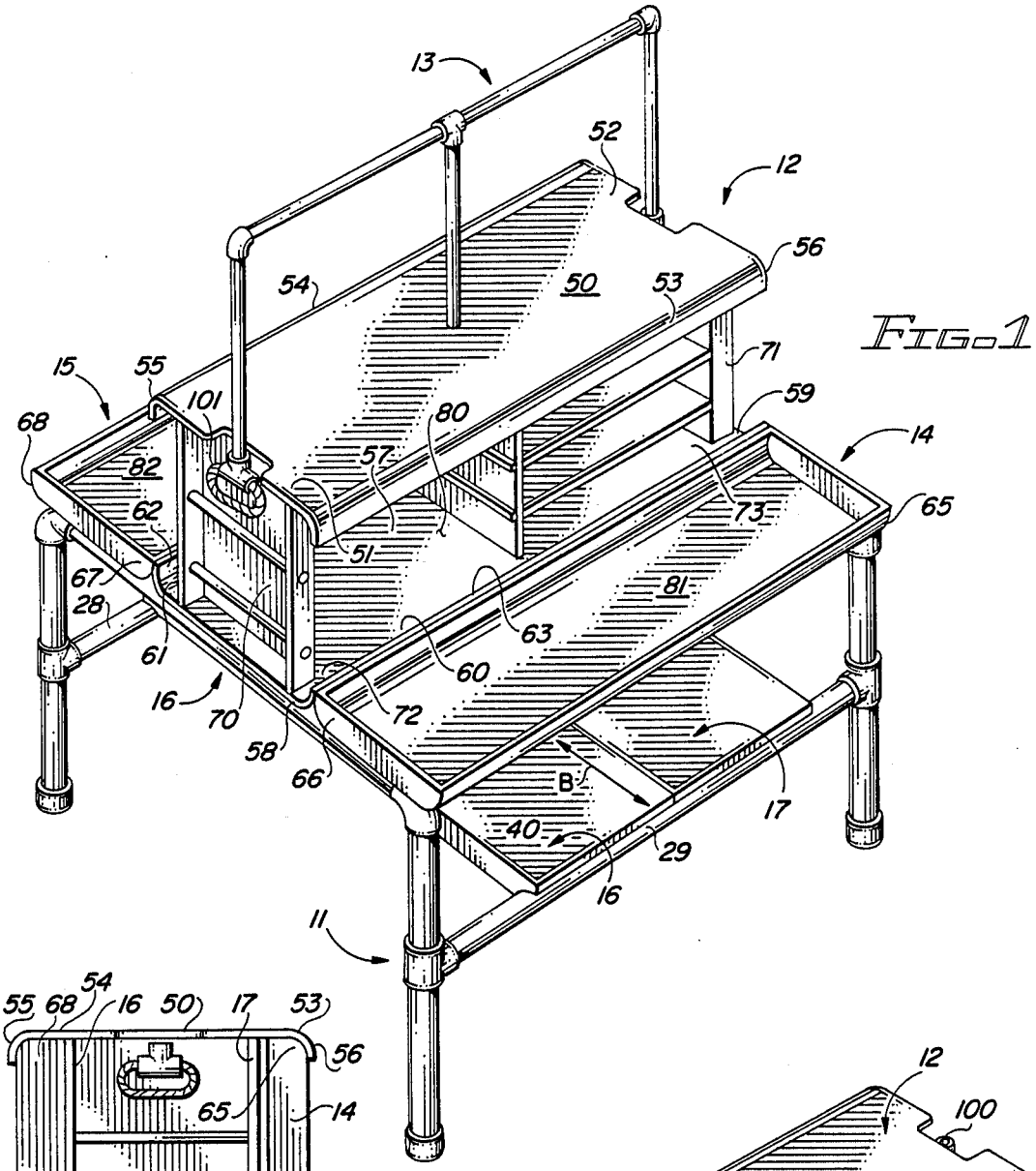
FIG. 1 is a perspective view of the work-storage unit constructed in accordance with the principles of the invention.
Figure 3:
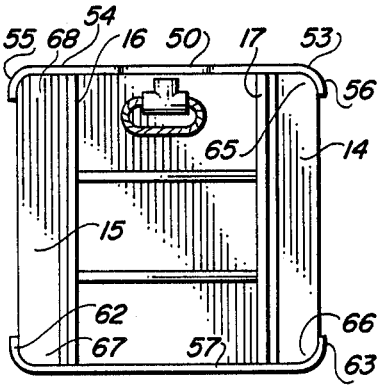
FIG. 3 is an end view illustrating the portable work-storage unit carrying case of FIG. 2.

Briefly, in accordance with the my invention, I provide an improved storage unit adapted to be disassembled and reassembled to provide work stations. The storage unit includes a top wall having opposed front and back edges and having first and second ends; a bottom wall having forward and rear edges and having first and second ends; a pair of spaced apart side walls each interconnecting one of the pair of first ends of the top and bottom walls and the pair of second ends of the top and bottom walls, the top, bottom and side walls circumscribing and defining an inner storage area having front and back openings which permit an individual to reach through the inner storage area from said front to said rear opening; elongate lips attached to and extending downwardly from the front and back edges of the top walls; second elongate lips attached to and extending upwardly from the front and back edges of the bottom wall toward the first lips; an elongate first door-container; an elongate second door-container; an articulated support frame including a plurality of rigid elongate elements adapted to be assembled to define a stand and disassembled for compact storage in at least one of the elongate first and second container, the frame when assembled including a pair of spaced apart horizontally oriented crossbars; and, elongate cover panels for the first and second door-containers. Each of the cover panels has ends shaped and dimensioned to removably rest on one of the cross bars such that the panels cannot be moved in directions perpendicular to the crossbars. The panels each span the distance between the crossbars to form a removable shelf thereon. Each of the door-containers when assembled with one of the cover panels is slidably received by and intermediate an opposing pair comprised of one of the first lips and one of the second lips to form a side of the storage container. The assembled stand, the bottom wall, and the door-containers are shaped and dimensioned such that when the bottom wall is placed on the assembled stand, each of the door-containers is placed on the stand adjacent one of the second edges to form a work station on the stand.

Turning now to the drawings, in which the presently preferred embodiments of the invention are shown for the purpose of illustrating the practice thereof and not by way of limitation of the scope of the invention and in which like elements are indicated by corresponding reference characters throughout the several views, FIGS. 1 to 8 illustrate a work-storage unit constructed in accordance with the principles of the invention and including an articulated stand 11, storage container 12, rack 13, door-containers 14 and 15, and cover panels 16 and 17.

Figures 4, 5, 6, 7, 8:
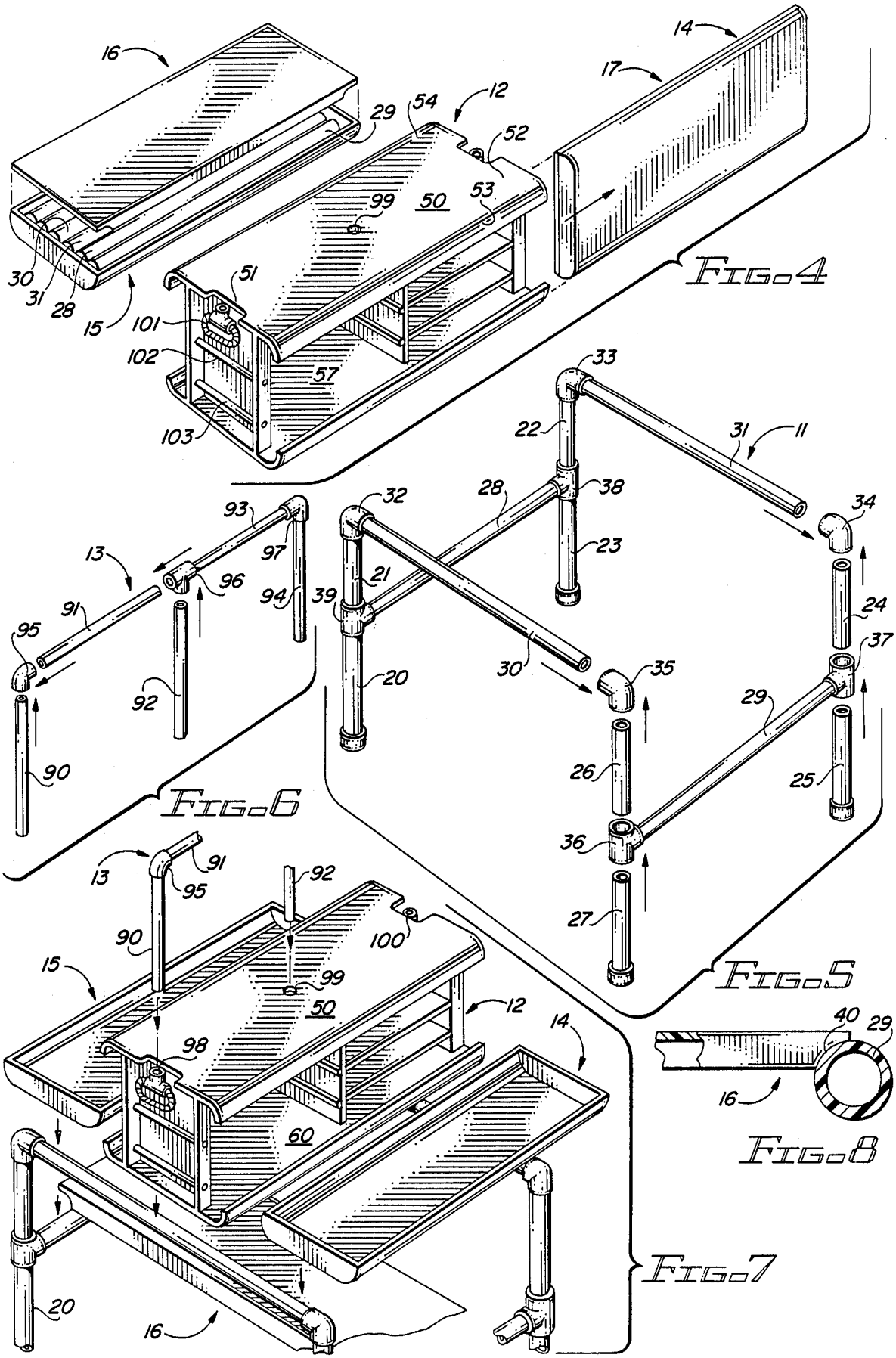
FIG. 4 is a perspective view illustrating the disassembly of the carrying case of FIG. 2 to form the work-storage unit of FIG. 1.
FIG. 5 is a perspective view illustrating the assembly of rigid, elongate elements to form an articulated support stand.
FIG. 6 is a perspective view illustrating the assembly of rigid, elongate elements to form an upstanding rack utilized in the work-storage unit of FIG. 1.
FIG. 7 is a perspective view further illustrating assembly of the work-storage unit of FIG. 1; and, FIG. 8 is a side view illustrating engagement of a cover panel with the articulated support stand.

As illustrated in FIG. 5, articulated stand 11 includes elongate hollow cylindrical elements 20 to 31 adapted to be slidably removably interfit and interconnected with L-shaped hollow connectors 32 to 35 and T-shaped hollow connectors 36 to 39.

Each end of a cover panel 16, 17 includes an elongate quarter-circular surface 40 which conform to either element 29 or 28 in the manner shown in FIGS. 1 and 8. When cover panels 16 and 17 are placed on elements 28 and 29 to form shelving, surfaces 40 prevent cover panels 16 and 17 from sliding in the directions indicated by arrows B in FIG. 1, i.e., surfaces 40 prevent panels 16 and 17 from moving in directions perpendicular to the longitudinal axes of elements 28 and 29.

Storage container 12 includes top wall 50 having first end 51, second end 52, front edge 53, and back edge 54. Spaced apart edges 53 and 54 are parallel. Downwardly extending elongate lips 55 and 56 are attached to edges 54 and 53, respectively. Storage container 12 also includes bottom wall 57 having first end 58 and second end 59 and parallel spaced apart forward edge 60 and rear edge 61. Upwardly extending elongate lips 62 and 63 are attached to edges 61 and 60, respectively. Door-container 14 includes elongate arcuate spaced apart parallel edges 65 and 66. Door-container 15 includes elongate arcuate spaced apart parallel edges 67 and 68. Bottom wall 57 includes first end 72 and second end 73. Side wall 70 interconnects ends 51 and 72 of walls 50 and 57, respectively. Side wall 71 interconnects ends 52 and 73 of parallel walls 50 and 57.

Figure 2:
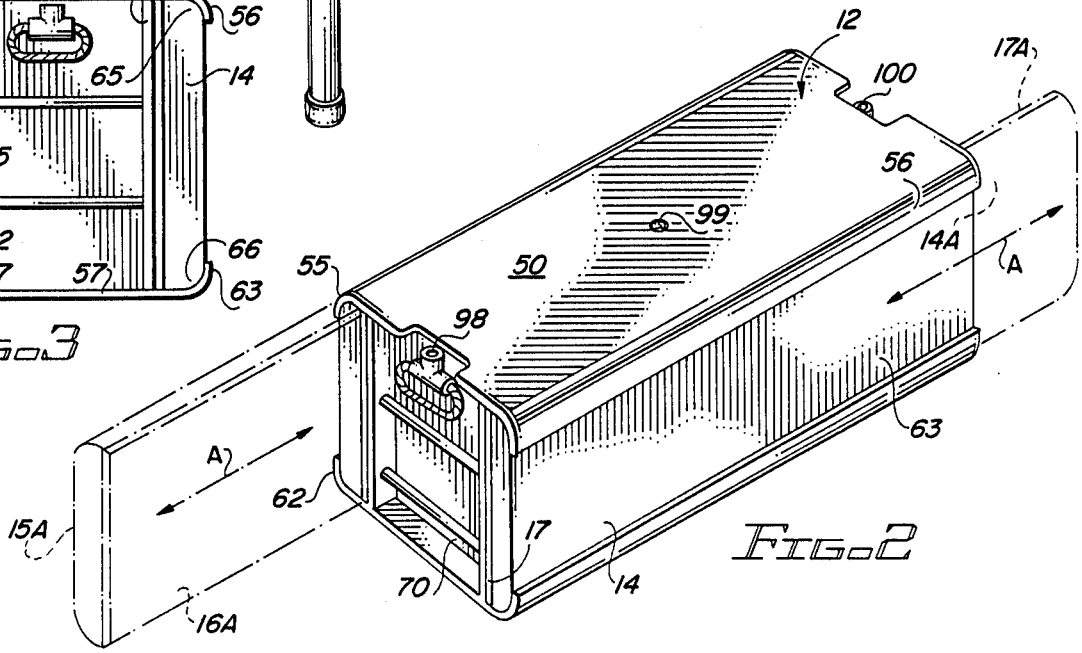
FIG. 2 is a perspective view of illustrating the work-storage unit of FIG. 1 disassembled and packaged to form a compact, portable carrying case.

Door-containers 14 and 15, cover panels 16 and 17, edges 55, 56, 62, 63, and storage container 12 are shaped and dimensioned such that door-containers 14 and 15 are, when covered with panels 16 and 17, slidably received in the manner indicated by dashed lines 15A, 16A, 17A, 14A and arrows A in FIG. 2. When door-containers 14 and 15 and cover panels 16 and 17 are slidably removed from storage container 12 and placed on stand 11 in the manner indicated in FIG. 1, there are not any upstanding front and back walls for container 12. Accordingly, in FIG. 1, an individual standing next to door-container 14 and element 29 could look through space 80 between walls 50 and 57 and see an individual standing on the other side of frame 11 adjacent door-container 15. This "see-through" or "pass through" capability facilitates use of the storage container 12 by two individuals. In FIG. 1 horizontally oriented surfaces 81 and 82 function as work surfaces or stations.

When elements 20 to 31 and connector 32 to 39 are disassembled they are stored in door-containers 14 and 15 in the manner illustrated in FIG. 4. If desired, elements 20 to 31 and connectors 32 to 39 can also be stored in container 12. Storage of the components of stand 11 in door-containers 14 and 15 facilitates, however, use of container 12 to carry foodstuffs, tools, and any other supplies desired to be transported therein.

Articulated rack 13 includes elongate hollow cylindrical elements 90 to 94 and connectors 95 to 97 which slidably removably receive elements 90 to 94. The lower ends of elements 90, 92 and 94 are slidably removably received by apertures 98, 99 and 100. Towels and other utensils can be hung from rack 13.

Door-containers 14 and 15 can, if desired, be hinged or otherwise attached to container 12 in the manner of conventional doors. Each side wall 70, 71 is provided with an exterior handle 101. Crossbars 102, 103 can be utilized as handles or as towel racks.

The work-storage unit of the invention is particularly advantageous because it provides a portable compact unit which can be readily assembled to provide elevated work surfaces. The door-containers 14 and 15 enable this utility because they serve four functions, namely, containers 14 and 15 serve as the sides of the storage-container 12, serve to store the elements of articulated stand 11, serve as work stations, and provide shelving for the stand 11.

Container 12 is symmetrical about a vertical plane perpendicular to wall 50 and passing through apertures 98, 99, 100.

Rack 13 can support a piece of material draped over rack 13. One side of the material can be attached to cover 14 and another side attached to cover 15 to form a "tent" which would protect container 12 from rain. The tent would extend from cover 14 over rack 13 to cover 15.

Having described my invention in such terms as to enable those skilled in the art to understand and practice it, and having identified the presently preferred embodiments thereof, I claim:

1. A work-storage unit adapted to be assembled to provide work stations and including (a) a top wall having opposed front and back edges and having first and second ends;

(b) a bottom wall having forward and rear edges and having first and second ends;

(c) spaced apart side walls each interconnecting (i) one of said pair of first ends of said top and bottom walls, and, (ii) one of said pair of second ends of said top and bottom walls;

said top, bottom and side walls circumscribing and defining an inner storage area having front and back opening which permit an individual to reach through said inner storage area from said front to said rear open areas;

(d) first elongate lips attached to and extending downwardly from said front and back edges of said top wall;

(e) second elongate lips attached to and extending upwardly from said front and back edges of said bottom wall toward said first lips;

(f) an elongate first door-container;

(g) an elongate second door-container;

(h) an articulated support frame including a plurality of rigid, elongate elements adapted to be assembled to define a stand and disassembled for compact storage in at least one of said elongate first and second containers, said frame when assembled including a pair of spaced apart horizontally oriented crossbars;

(i) elongate cover panels for said first and second door-containers, each of said cover panels having ends shaped and dimensioned to removably rest on one of said crossbars such that said panels cannot be moved in directions perpendicular to said crossbars, said panels each spanning the distance between said crossbars to from a shelf thereon, each of said containers when assembled with one of said cover panels being slidably received by and intermediate an opposing pair comprised of one of said first lips and one of said second lips to form a side of said storage container, each of said assembled stand, said bottomwall, and said containers being shaped and dimensioned such that when said bottom wall is placed on said assembled stand each of said containers is placed on said stand adjacent one of said second edges to form a work station on said assembled stand.

* * * * *